US007938692B2

(12) United States Patent
Vejux

(10) Patent No.: US 7,938,692 B2
(45) Date of Patent: May 10, 2011

(54) QUICK-CONNECTION SYSTEM FOR CONNECTING ELECTRICAL CABLES TO A BATTERY

(75) Inventor: Jean-Marie Vejux, Miserey Salines (FR)

(73) Assignee: CML Innovative Technologies, Besancon (FR)

( * ) Notice: Subject to any disclaimer, the term of this patent is extended or adjusted under 35 U.S.C. 154(b) by 43 days.

(21) Appl. No.: 12/304,448

(22) PCT Filed: May 24, 2007

(86) PCT No.: PCT/FR2007/051322

§ 371 (c)(1),
(2), (4) Date: Dec. 11, 2008

(87) PCT Pub. No.: WO2007/147989

PCT Pub. Date: Dec. 27, 2007

(65) Prior Publication Data

US 2009/0280699 A1 Nov. 12, 2009

(30) Foreign Application Priority Data

Jun. 23, 2006 (FR) ..... 06 05628

(51) Int. Cl.
*H01R 4/50* (2006.01)

(52) U.S. Cl. ..... 439/772

(58) Field of Classification Search ..... 439/772, 439/773, 754, 762, 258, 763, 764
See application file for complete search history.

(56) References Cited

U.S. PATENT DOCUMENTS

| | | | | |
|---|---|---|---|---|
| 4,964,819 | A * | 10/1990 | Caraballo | 439/773 |
| 5,738,552 | A * | 4/1998 | Halbach et al. | 439/762 |
| 6,773,310 | B2 * | 8/2004 | Davis | 439/773 |
| 6,830,490 | B2 * | 12/2004 | Murakami et al. | 439/755 |
| 7,303,448 | B1 * | 12/2007 | Sproesser | 439/773 |

FOREIGN PATENT DOCUMENTS

| | | |
|---|---|---|
| EP | 1498987 | 1/2005 |
| FR | 2745123 | 8/1997 |
| FR | 2776424 | 9/1999 |

* cited by examiner

*Primary Examiner* — Jean F Duverne
(74) *Attorney, Agent, or Firm* — Egbert Law Offices PLLC

(57) ABSTRACT

The present invention relates to a battery connection with an anti-locking system including a casing for connection of the electric cables furnished with a lever articulated between a locked position and an unlocked position. The connection has an anti-locking system preventing the lowering of the lever and hence the locking of the connection on the battery terminal, if the interlocking is not correctly achieved. The anti-locking system includes a detector that can be moved between two configurations which correspond to the locked position and to the unlocked position of the connection and is suitable, in the configuration corresponding to the locked position, for pressing against a surface of the battery containing the battery terminal.

8 Claims, 2 Drawing Sheets

QUICK-CONNECTION SYSTEM FOR CONNECTING ELECTRICAL CABLES TO A BATTERY

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The invention relates to a quick-connection system for connecting electric cables to a battery.

2. Description of Related Art Including Information Disclosed Under 37 CFR 1.97 and 37 CFR 1.98

In the field of connectors of electric cables to battery cable terminals, it is known practice to employ various interlocking endpieces for quick connection to the battery.

For example, in patent FR 2 745 123 of the applicant, a connector for a battery terminal has been proposed, comprising a clipping system preventing removal and allowing productivity gains on motor vehicle assembly lines.

In document FR 2 776 424, a quick-connection system has also been proposed that allows the electric cables to be connected without it being necessary to use any tools.

This quick-connection system makes it possible to lock the cable terminal by interlocking with the battery terminal in an insulation casing protecting it from the surrounding atmosphere and ensuring tight contact between the cable terminal and the battery terminal.

This contact between the cable terminal and the battery terminal, in the conventional connections comprising a clamping by means of a collar immobilized by screwing, usually tends to deteriorate over time, which results in a loss of performance of the battery and sometimes oxidation of the cable terminals. The vibrations generated by the vehicle may also cause, with time, a slippage of the connection and bad contacts.

The solution proposed in patent FR 2 776 424 makes it possible to solve these problems to the extent that the quick-connection device is correctly adjusted on the battery terminals, which unfortunately is not always the case.

Specifically, because of the lack of time, the difficulty of access or the awkward working conditions, the quick-connection system is frequently badly interlocked, which results in the loss of conduction in the cables and the stopping ofthe engine or inappropriate electrical discharges between the cable terminal and the battery terminal or else, in most cases, the slipping of the cable terminal around the battery terminal and the same problems as those frequently encountered in the conventional connectors.

There is therefore a problem to be solved in relation to the incorrect interlocking of the quick-connection with the battery terminal.

Document EP 1 498 987 describes a battery connection with an anti-locking system preventing the connection from locking if the interlocking is not correctly achieved. For this, the locking is allowed only if a lever is in contact with the top face of the battery terminal.

However, the tolerances accepted during manufacture of the battery terminals may cause the connection to be incorrectly installed.

The object of the invention is therefore to solve this difficulty and improve the existing quick-connection system by proposing an anti-locking system preventing an incomplete interlocking of the cable terminal with the battery terminal.

BRIEF SUMMARY OF THE INVENTION

The present invention proposes a battery connection with an anti-locking system comprising a casing for connection of the electric cables furnished with a lever articulated between a locked position and an unlocked position, having an anti-locking system preventing the lowering of said lever and therefore the locking of the connection to the battery terminal if the interlocking is not correctly achieved. The anti-locking system comprises a detector that can be moved between two configurations which correspond to the locked position and to the unlocked position of the connection and is suitable, in the configuration corresponding to the locked position, for pressing against a surface of the battery containing the battery terminal.

The advantages of the anti-locking device for a battery connection according to the invention are many:

- a correct interlocking of the connection is verified relative to the surface of the battery and not relative to the battery terminal. It is therefore possible to correctly position the connection even if the battery terminal has different dimensions due notably to the accepted manufacturing tolerances;
- the device does not allow locking unless the cable terminal of the connection is pushed fully home, which removes all the known problems of incorrect attachment;
- if the connection is not correctly made, the locking lever remains raised, clearly showing the installer that the connection has not been made;
- the anti-locking mechanism is simple to operate and reliable, which ensures satisfactory maintenance of functionality over time; and
- the anti-locking device is incorporated into the locking mechanism and corresponds to a very slight extra manufacturing cost for the connection part, which is economically advantageous.

BRIEF DESCRIPTION OF THE SEVERAL VIEWS OF THE DRAWINGS

Other features and advantages of the invention will emerge from the following description with respect to the appended drawings, which are given only as non-limiting examples.

DETAILED DESCRIPTION OF THE INVENTION

Figure 1:
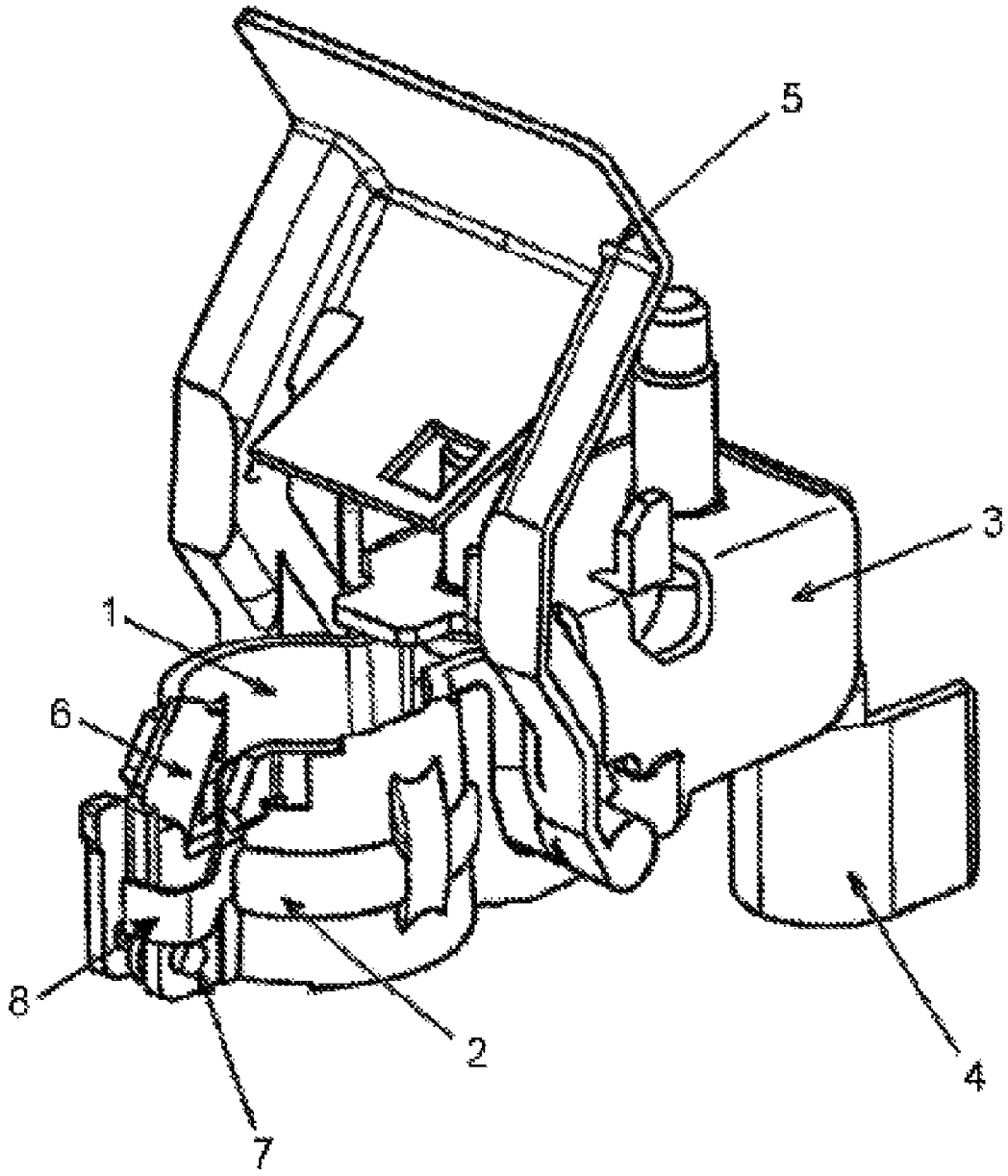
FIG. 1 is a view in perspective of a quick-connection device comprising an anti-locking system according to the invention.

As shown in FIG. 1, a battery connection comprising the anti-locking system according to the invention is configured in a manner similar to that described in patent FR 2 776 424 of the applicant.

More precisely, the attachment of the cable terminal 1 to the battery terminal is made by means of a clamping spring 2 situated on the periphery of the cable terminal.

In a known manner, the battery connection comprises a casing 3 into which the electric cables run and are connected to the cable terminal, and a collar 4 in contact with the battery host and receiving the cables.

A lever 5 articulated rotatably between a locked position and an unlocked position makes it possible to immobilize the connection and hold the cable terminal firmly on the battery terminal.

The anti-locking device prevents the lowering of the lever 5 and therefore the locking of the connection on the battery terminal if the interlocking is not correctly achieved.

More precisely, the anti-locking system comprises a detector 6 that can be moved between two configurations which correspond to the locked position and the unlocked position of the connection.

The detector 6 is directly connected to the cable terminal 1 designed to be interlocked with the battery terminal.

More precisely, the detector 6 is a metal part that can be moved rotatably about a pin 7. The detector is connected to a return spring 8 which has the effect of forcing the detector to rotate and hence of preventing the connection from being locked.

The hinge pin 7 of the detector 6 is located beneath the return spring 8 of the detector so that, in the rest position, that is to say when the connection is not locked onto the battery terminal, the detector 6 is tipped in a position that is inclined in the direction of the cable terminal 1 in a configuration called unlocked.

When the cable terminal is correctly interlocked with the battery terminal, the detector 6 is tipped into a substantially vertical position after rotation about the pin 7. This configuration is called locked.

Therefore, the movement of the detector 6 between the two configurations is made as a rotation about the pin 7, the return spring having the effect of bringing the detector into the unlocked configuration if the cable terminal is not fully interlocked with the battery terminal.

The detector as shown in the various figures has an elongated and curved shape with a concavity oriented toward the battery terminal. The height of this part is very slightly greater than the height of the battery terminal.

Figure 2:
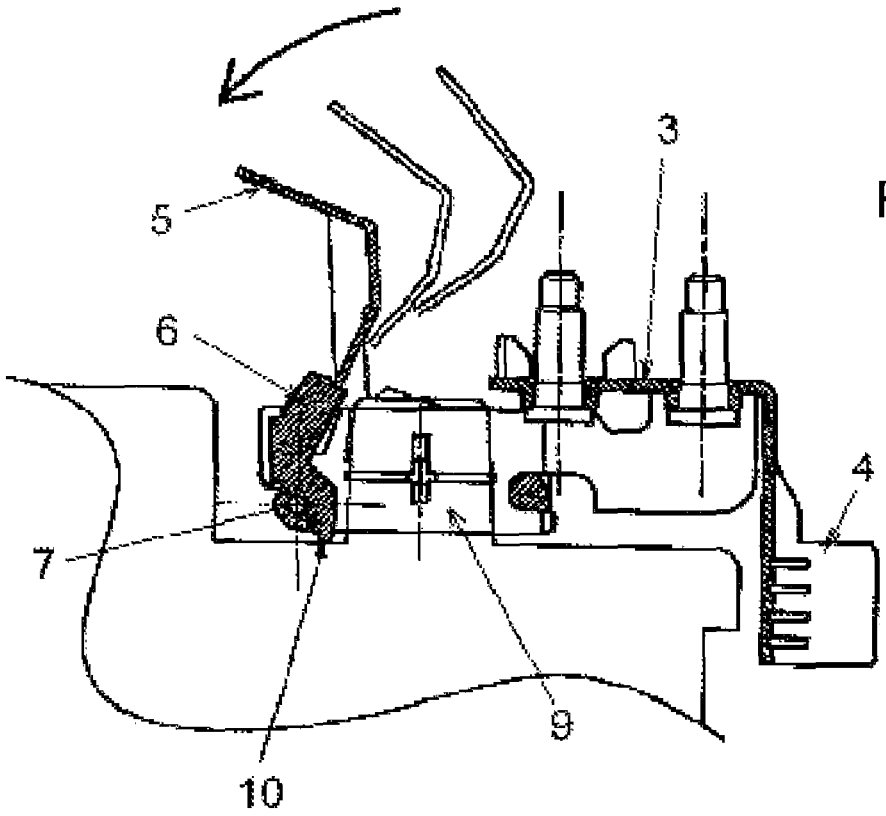
FIG. 2 is a view in section and from the side of the anti-locking mechanism in a situation of incomplete interlocking of the cable terminal with the battery terminal.
Figure 3:
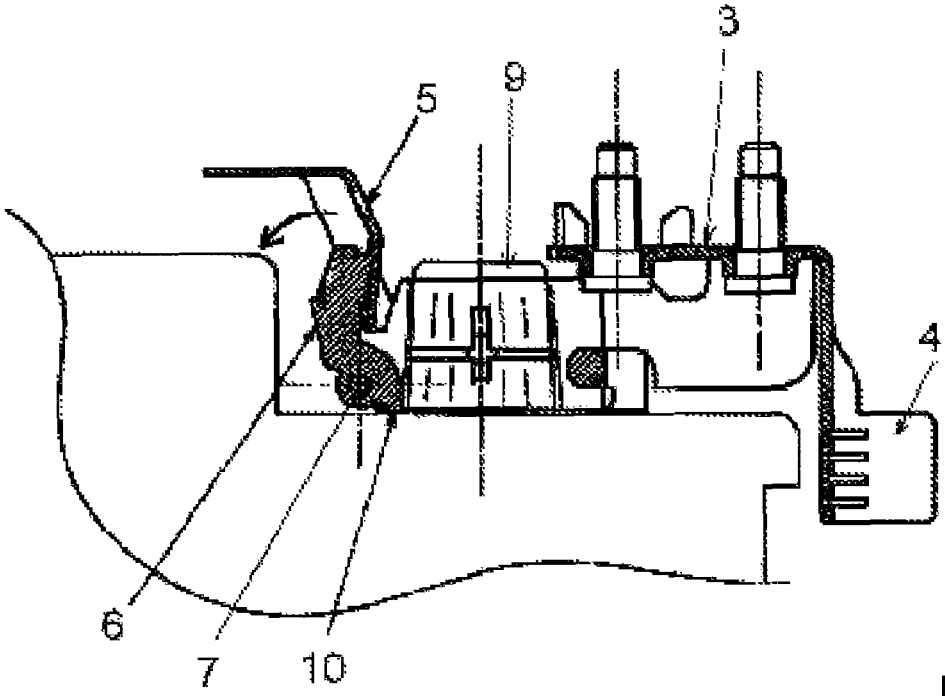
FIG. 3 illustrates, in a side view and in section, a situation in which the cable terminal is correctly interlocked and locking is allowed.

FIGS. 2 and 3 illustrate two possible positions for the detector 6 in the locked and unlocked configurations.

In FIG. 2, the battery terminal 9 is not correctly interlocked in the connection. The return spring is keeping the detector 6 in an unlocked configuration, that is to say tipped in the direction of the battery terminal. The lever 5, during its rotary movement toward the locked position, that is to say in the direction of movement indicated by the arrow in FIG. 2, is immobilized by the top portion of the detector 6.

The lever 5, immobilized in its travel, remains in the raised position, easily visible to the installer.

The detector 6 comprises, in its lower portion, that is to say the portion close to the top of the battery, a foot 10 positioned beneath the pin 7 that is used for the rotation of said detector.

As shown in FIGS. 2 and 3, the foot 10 of the detector is positioned between the pin 7 and the battery terminal 9 and between the pin 7 and the top of the battery.

When the connection is correctly interlocked with the battery terminal, when the lower portion of the cable terminal makes contact with the top of the battery, as illustrated in FIG. 3, the foot 10 of the detector presses on the top of the battery, which has the effect of pushing the detector and making it pivot about the pin 7.

This rotary movement results in a tipping of the detector toward a substantially vertical position which clears the space necessary for the lever 5 to be able to slide between the detector and the cable terminal and therefore allow the connection to be locked.

In this locked position, the end of the lever 5 is in a substantially horizontal position.

In the locked position, the lever 5 compresses the clamping spring 2 responsible for holding the cable terminal firmly attached to the battery terminal.

Therefore, according to the invention, the foot 10 of the detector 6 is placed between the hinge pin 7 and the bottom of the battery terminal 9 so as to cause said detector 6 to tip toward the vertical position, that is to say toward the locked position, when the connection is correctly interlocked with said battery terminal 9 and said foot 10 presses on the top of the battery.

When the lever 5 is raised, the movement between the locked configuration and the unlocked configuration of the detector 6 is made by means of the return spring 8.

Preferably, the detector 6 and the anti-locking system are positioned opposite to the cable entry, so that the connection operation is easily achieved by the person responsible for the work.

Advantageously, according to the invention, the clamping spring 2 and the return spring 8 may be formed in a single piece arranged on the cable terminal 1 of the connection.

Several variants are possible for the anti-locking system supported by the battery connection. Notably, it is possible to envisage other devices preventing the lowering of the lever, a different immobilization mechanism, and various conformations of the lever and of the essential parts without departing from the context of the invention.

The foot of the detector and the detector itself may be formed in different ways without departing from the context of the invention.

The various parts used in the connection are advantageously metallic; however, certain elements could be envisaged as being made of rigid plastic without departing from the context of the invention.

Naturally, the invention is not limited to the embodiments described and shown as examples, but it also includes all the technical equivalents and their combinations.

I claim:

1. A connection apparatus for use with a terminal extending upwardly from a surface of the battery, the connection apparatus comprising:

a casing suitable for connection to electric cables;

a lever articulated at a lower end thereof to said casing so as to be movable about a horizontal axis between a lowered locked position and a raised unlocked position;

a means for preventing a movement of said lever to said locked position when the battery is not properly positioned relative to said casing, said means comprising a detector movable between a first position corresponding to said locked position of said lever and a second position corresponding to said unlocked position of said lever, said detector having a surface arranged so as to press against the surface of the battery when in said first position, said detector extending substantially vertically when in said first position so as to define a space between said detector and the terminal of the battery, said lever positioned in said space when in said locked position.

2. The connection apparatus of claim 1, further comprising:

a returning spring cooperative with said detector so as to urge said detector toward said second position.

3. The connection apparatus of claim 2, said return spring cooperative with said detector so as to urge said detector to rotate in a direction toward the terminal.

4. The connection apparatus of claim 3, said casing having a cable terminal suitable for electrical connection to the terminal of the battery, said detector being directly connected to said cable terminal.

5. The connection apparatus of claim 4, further comprising:

a pin mounted to said casing, said detector hingedly connected to said pin, said detector being inclined in a detector toward said cable terminal when in said second position.

6. The connection apparatus of claim 5, said pin being positioned beneath said return spring.

7. The connection of claim 5, said detector having a foot extending outwardly therefrom, said foot positioned beneath said pin.

8. The connection of claim 7, said foot positioned between said pin and a bottom of the terminal of the battery so when said detector is in said first position, said foot pressing on the surface of the battery when said detector is in said first position.

* * * * *